US007997351B2

(12) United States Patent
Murray

(10) Patent No.: US 7,997,351 B2
(45) Date of Patent: Aug. 16, 2011

(54) PNEUMATIC DRIFTER WITH REPLACEABLE FOOT PIECES

(75) Inventor: William James Murray, Malanshof (ZA)

(73) Assignee: Longyear TM, Inc., South Jordan, UT (US)

( * ) Notice: Subject to any disclaimer, the term of this patent is extended or adjusted under 35 U.S.C. 154(b) by 251 days.

(21) Appl. No.: 12/337,510

(22) Filed: Dec. 17, 2008

(65) Prior Publication Data

US 2009/0283284 A1 Nov. 19, 2009

Related U.S. Application Data

(60) Provisional application No. 61/054,405, filed on May 19, 2008.

(51) Int. Cl.
*B23B 45/16* (2006.01)

(52) U.S. Cl. ..... 173/31; 173/207; 173/6

(58) Field of Classification Search ..... 173/31, 173/207, 6

See application file for complete search history.

(56) References Cited

U.S. PATENT DOCUMENTS

| | | | | |
|---|---|---|---|---|
| 837,515 | A | | 12/1906 | Stephens |
| 1,804,187 | A | | 5/1931 | Terry |
| 1,831,445 | A | | 11/1931 | Hansen |
| 1,918,065 | A | | 7/1933 | Terry |
| 1,981,992 | A | | 11/1934 | Curtis |
| 2,288,075 | A | | 6/1942 | Gay |
| 2,368,932 | A | | 2/1945 | Lincoln |
| 2,630,353 | A | | 3/1953 | Rutz |
| 3,106,117 | A | | 10/1963 | Duquesnel |
| 3,150,723 | A | * | 9/1964 | Hale ..... 173/37 |
| 3,612,190 | A | * | 10/1971 | Wills ..... 173/20 |
| 3,627,436 | A | * | 12/1971 | Adams et al. ..... 408/63 |
| 3,650,576 | A | | 3/1972 | Hughes |
| 3,692,124 | A | * | 9/1972 | Kimber et al. ..... 173/160 |
| 3,965,997 | A | * | 6/1976 | Hilding et al. ..... 175/65 |
| 3,980,144 | A | * | 9/1976 | Roos et al. ..... 173/160 |
| 4,251,046 | A | * | 2/1981 | Walmsley et al. ..... 248/660 |
| 4,290,491 | A | * | 9/1981 | Mayer ..... 173/194 |
| 4,682,899 | A | | 7/1987 | Andersson |
| 4,684,266 | A | | 8/1987 | Furmanek et al. |
| 4,925,320 | A | | 5/1990 | Foster et al. |
| 5,560,713 | A | | 10/1996 | Christenson |
| 5,678,642 | A | * | 10/1997 | Briggs et al. ..... 175/19 |
| 5,704,716 | A | | 1/1998 | Jantunen |
| 5,735,610 | A | | 4/1998 | Mark et al. |
| 5,884,712 | A | * | 3/1999 | Hakkinen ..... 173/11 |
| 5,988,298 | A | | 11/1999 | Cheng et al. |
| 6,105,684 | A | | 8/2000 | Pointer et al. |
| 6,705,407 | B2 | | 3/2004 | Heinonen et al. |
| 2007/0227752 | A1 | | 10/2007 | Voimanen et al. |
| 2008/0169113 | A1 | * | 7/2008 | Rubie ..... 173/141 |
| 2009/0090530 | A1 | * | 4/2009 | Roberts et al. ..... 173/219 |

FOREIGN PATENT DOCUMENTS

GB 2216440 GB 11/1989

* cited by examiner

*Primary Examiner* — Brian D Nash
(74) *Attorney, Agent, or Firm* — Workman Nydegger

(57) ABSTRACT

Pneumatic drifters containing a drifter cylinder with removable feet and associated methods for using the pneumatic drifters are described. The removable feet are connected to feet pad of a drifter cylinder with multiple fasteners. The mating surfaces of the feet and the feet pad are provided with complimentary features that limit the shearing forces on the fasteners during operation of the drifter rock drill. The removable feet can be replaced quickly and easily without have to replace the entire drifter cylinder, thereby saving time and reducing costs. Other embodiments are also described.

16 Claims, 5 Drawing Sheets

PNEUMATIC DRIFTER WITH REPLACEABLE FOOT PIECES

CROSS-REFERENCE TO RELATED APPLICATIONS

This application claims the benefit of U.S. Provisional Patent Application Ser. No. 61/054,405 filed May 19, 2008, which is hereby incorporated by reference in its entirety.

BACKGROUND OF THE INVENTION

1. The Field of the Invention

This application relates generally to drilling methods and devices used in drilling. In particular, this application relates to pneumatic drifters containing a drifter cylinder with removable feet and associated methods for using the pneumatic drifters.

2. The Relevant Technology

Many drilling processes are currently known and used. One type of drilling process, rock drilling, often includes drilling holes in a rock or other hard formation to fracture the rock so it can be removed. If necessary, explosives can also be placed in the holes and used to break and fracture the rock further. One type of drill used in rock drilling is commonly known as a "drifter."

Drifters are usually powered by pneumatic or hydraulic pressure. Because of maintenance considerations, pneumatic drifters are used more commonly than hydraulic drifters. Pneumatic drifters include a cylindrical drilling mechanism (also called a drifter cylinder) that is mounted in a sliding frame and driven in the direction of the hole being drilled by an air driven feed mechanism, such as a screw or chain. The drifter uses percussion, rotation, and pressure to drill the desired hole in the hard formation.

The sliding frame of the drifter, also called a feed slide, may be made of aluminum to save weight and enhance portability. The body cylinder is coupled to the feed slide by using integral two foot pieces. The drifter cylinder, including the integral foot pieces, is a precision-manufactured component that can be both large and costly. During operation, the foot pieces of the cylinder can wear rapidly due to the grit resulting from the drilling process. Although the slide frame is usually made of a softer material than the drifter cylinder, the drifter cylinder foot pieces wear more quickly than the slide frame because the grit embeds in the softer material of the slide frame, wearing on the drifter cylinder foot pieces as the drifter cylinder slides along the slide frame. This wear results in failure of the drifter cylinder feet, requiring replacement or expensive repair of the entire drifter cylinder.

BRIEF SUMMARY OF THE INVENTION

This application describes pneumatic drifters containing a drifter cylinder with removable feet and associated methods for using the pneumatic drifters. The removable feet are connected to the feet pads of a drifter cylinder with multiple fasteners. The mating surfaces of the feet and the feet pads are provided with complimentary features that limit the shearing forces on the fasteners during operation of the drifter rock drill. The removable feet can be replaced quickly and easily without have to replace the entire drifter cylinder, thereby saving time and reducing costs.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other aspects of the invention, a more particular description of the invention will be rendered by reference to specific embodiments thereof which are disclosed in the appended drawings. It is appreciated that these drawings disclose aspects of only some example embodiments of the invention and are therefore not to be considered limiting of its scope. Embodiments of the invention will be described and explained with additional specificity and detail through the use of the accompanying drawings in which.

DETAILED DESCRIPTION OF THE PREFERRED EMBODIMENTS

The following description supplies specific details in order to provide a thorough understanding. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques conventionally used in the industry. For example, while the description below focuses on drifter cylinders in pneumatic drifter rock drill operations, the apparatus and associated methods could be equally applied to other processes such as hydraulic drifter rock drilling, various percussive drilling processes, and the like.

Figure 1:
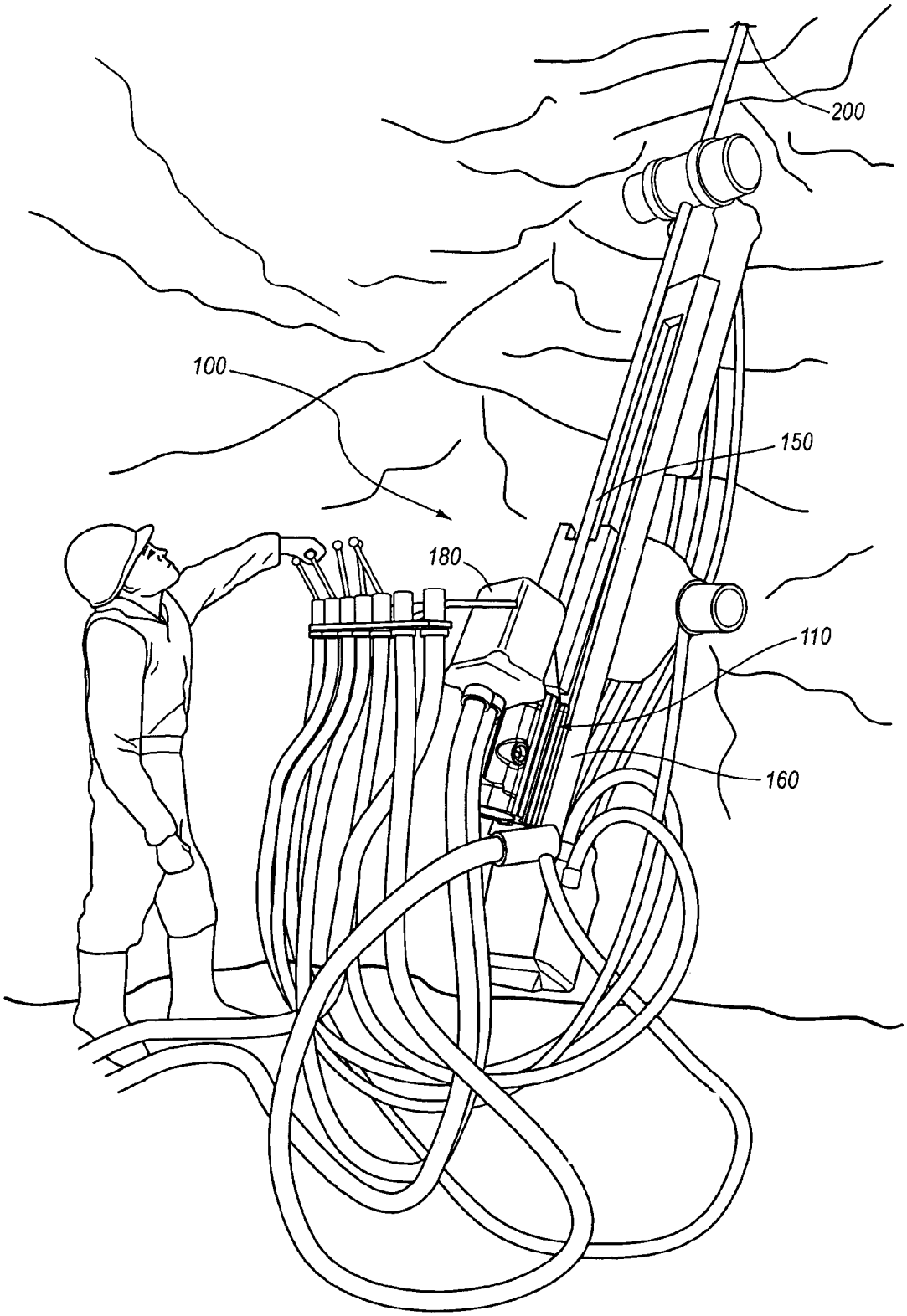
FIG. 1 is a perspective view disclosing aspects of an example embodiment of a drifter rock drill.

One example embodiment of a drifter rock drill containing a drifter cylinder with replaceable feet is illustrated in the Figs. FIG. 1 discloses a drifter rock drill 100 including a drifter cylinder 110, a drill bit 150, a slide frame 160, and a drive mechanism 180. The drifter rock drill 100 can be used for drilling a hole 200 into rock formations or other hard formations in the earth. The hole 200 can then be used to create fractures in the rock formation with explosives or with other means to allow removal of the fractured rock. The drifter cylinder 110 can be made of steel, or any other material suitable for use in a drifter cylinder in a rock drill 100. The slide frame 160 can be made of aluminum, aluminum alloys, or any other material suitable for use in a slide frame.

Figure 2:
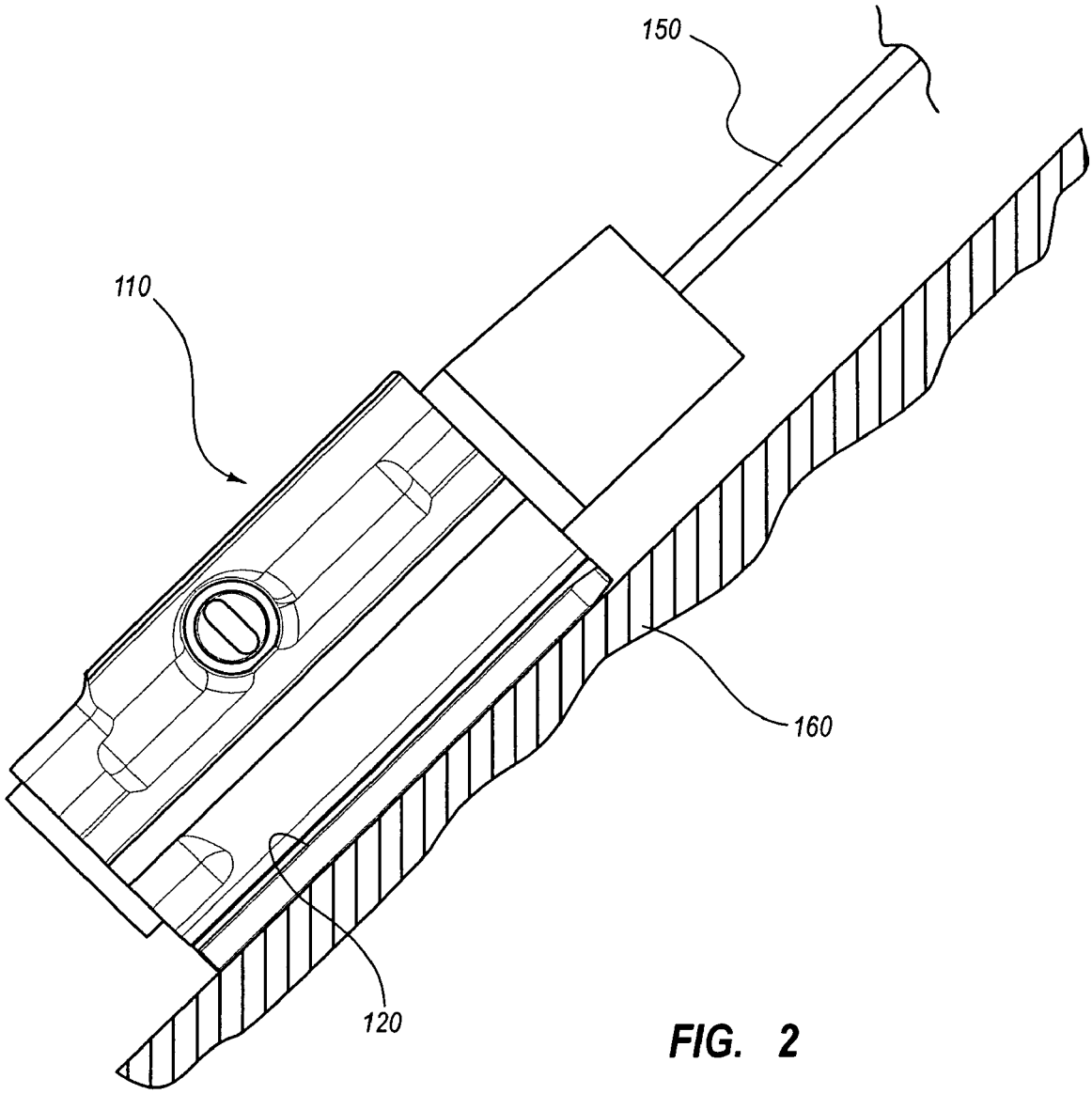
FIG. 2 is a cross-sectional view disclosing aspects of a portion of a drifter rock drill.
Figure 3:
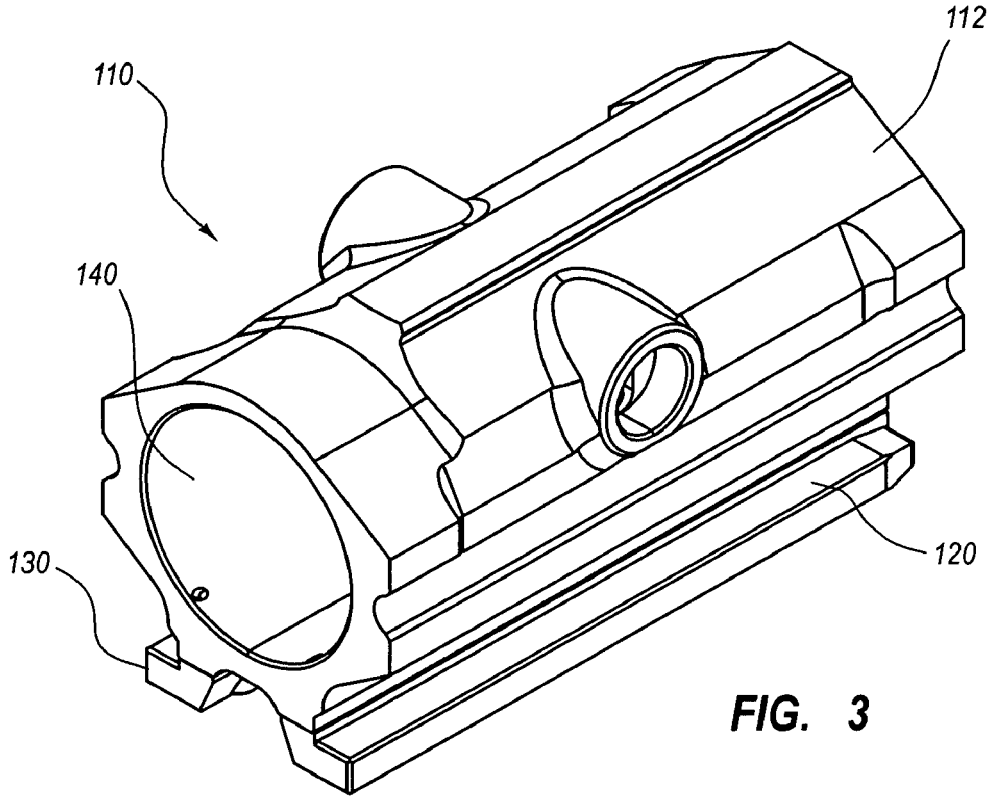
FIG. 3 is a perspective view disclosing aspects of an example embodiment of a drifter cylinder.

As shown in FIGS. 1-2, the drifter cylinder 110 rests on slide frame 160. The drifter rock drill 100 can rotate a drill bit 150 coupled to the drifter cylinder 110 and transmit a percussive motion to drifter cylinder 110 and the drill bit 150. As the drive mechanism 180 creates the percussive motion, the drifter cylinder 110 slides on slide frame 160 on replaceable feet, such as a right foot 120 and a left foot (shown in 130, FIG. 3). The drifter cylinder 110 advances further along the length of the slide frame 160 as the hole 200 becomes deeper in the hard formation. As the hole 200 is created, debris and grit from the drilling operation can be created and, along with drilling fluid from the drilling operation, fall onto the rock drill 100. In certain conditions, the debris and grit can become located between the feet 120, 130, and the slide frame 160, causing the feet 120, 130 to become worn from moving with respect to slide frame 160.

In the examples, illustrated in FIGS. 3-6, the drifter cylinder 110 contains a central channel 140. The channel 140 can have any configuration that functions with other components of the rock drill 100 as desired. For example, the central channel can be configured to contain the components that will drive the drill bit 150 into the hard formation.

The drifter cylinder 110 contains the replaceable feet 120, 130. The replaceable feet 120, 130 are configured to contact and slide along slide frame 160. While the feet 120 and 130 are shown as a single continuous piece, either one or both can be made of smaller pieces that are spaced along the length of the drifter cylinder. As well, while two feet are illustrated in the Figs, the drifter cylinder can contain any number of replaceable feet.

Figure 5:
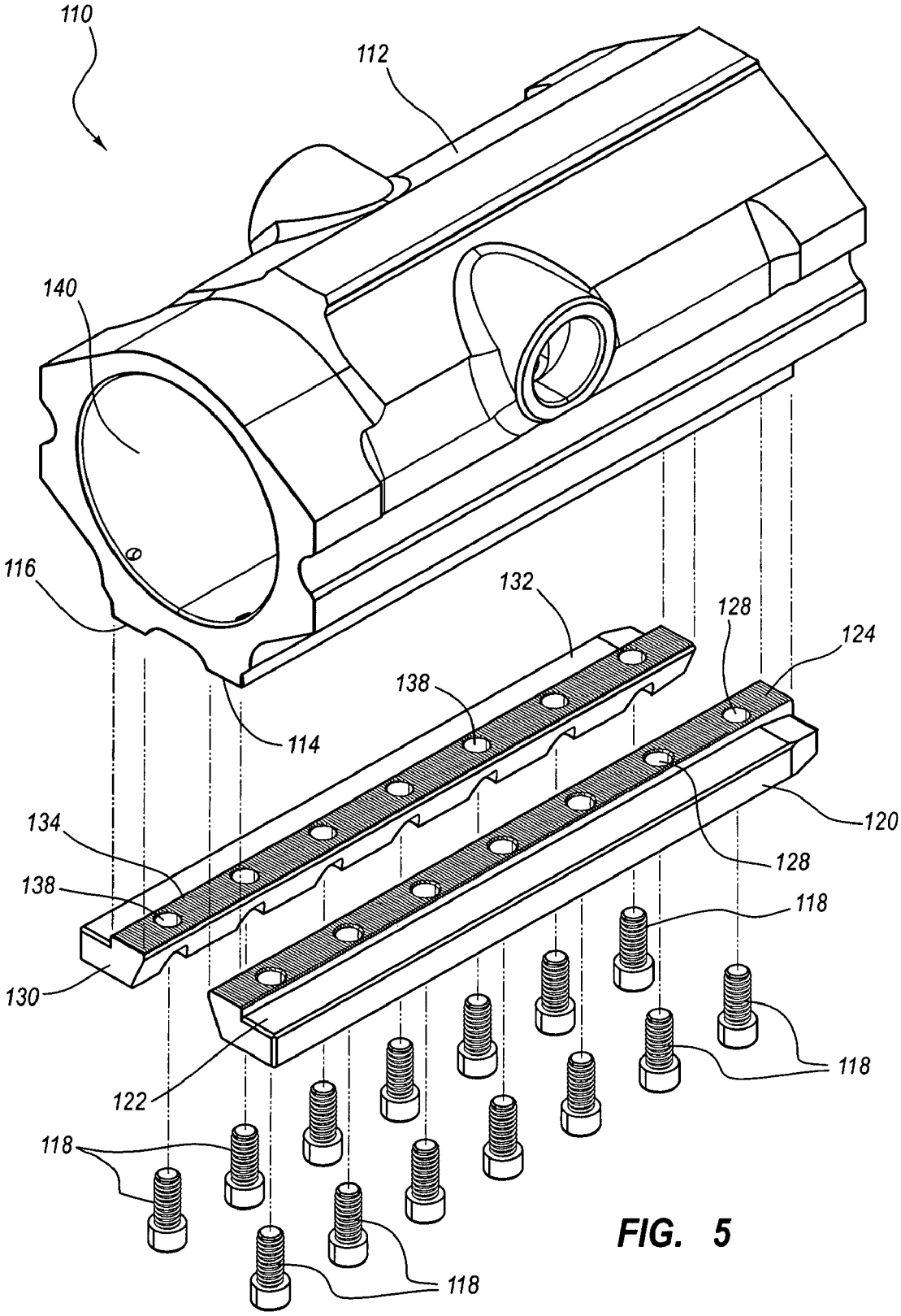
FIG. 5 is an exploded view disclosing aspects of an example embodiment of a drifter cylinder.

The bottom of the right foot 120 can be configured to connect or mate with the corresponding parts of the slide frame 160. For example, as illustrated in FIG. 5 configurations for the bottom of the right foot 120 can include ridges. In particular, the right foot 120 can have a ridge (or a series of ridges) 122, configured to cooperate with corresponding features on the slide frame 160 to keep the right foot 120 in the correct position in the drifter rock drill 100. Similarly left foot 130 can also have a ridge (or series or ridges) 132 serving a similar function.

The right foot 120 and left foot 130 can be removably coupled to the drifter cylinder 110 using any mechanism known in the art. In some embodiments, the feet 120 and 130 can be attached to cylinder body 112 of the drifter cylinder 110 by fasteners 118. The fasteners 118 can be bolts, screws, pins, or any other apparatus that allow feet 120 and 130 to be selectively removable from the cylinder body 112. Fasteners 118 can be distributed along the length of the feet 120, 130 with any desired spacing. The types of fasteners used can vary from one foot to the next, and can even vary along the length of a foot.

The number of fasteners 118 used can depend on various factors such as the spacing and the desired connection strength, the size of drifter cylinder 110, and the design of the drifter rock drill 100. In some examples, each of the feet 120,130 can have any number of fasteners. In other embodiments, the numbers of fasteners can range from 6 to 8 in each foot 120 and 130.

Figure 4:
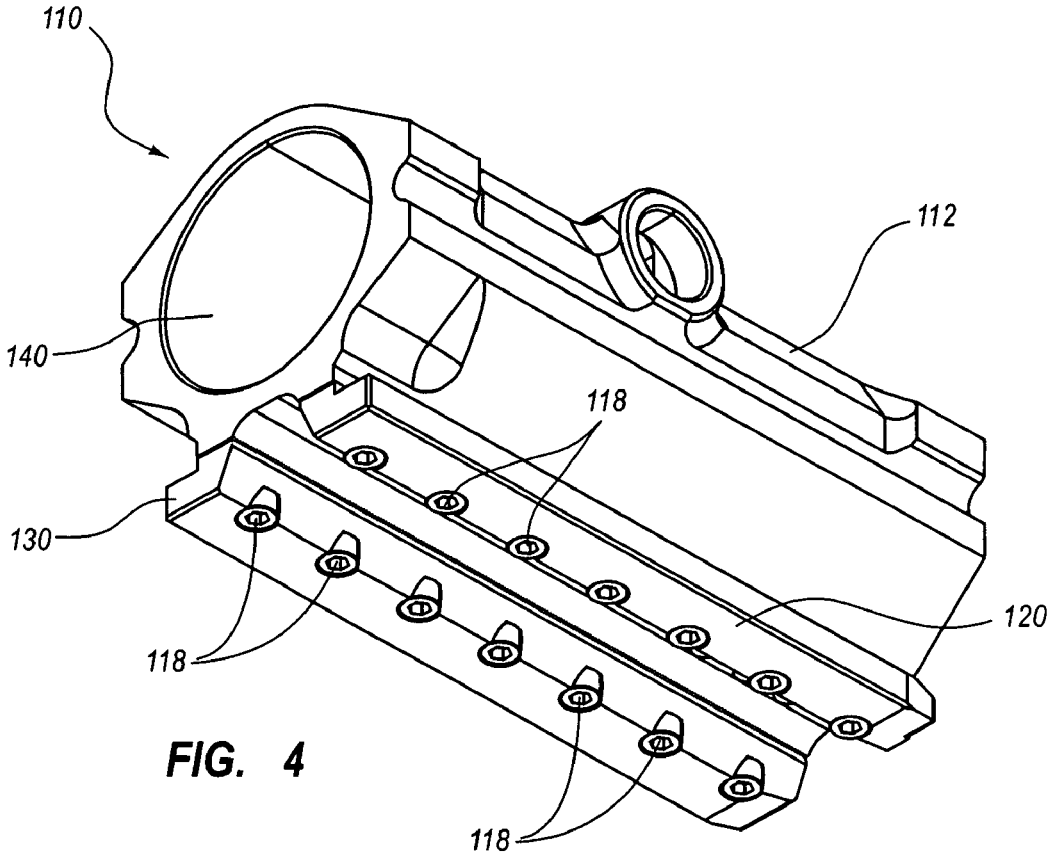
FIG. 4 is a perspective view disclosing aspects of an example embodiment of a drifter cylinder.

As shown in FIG. 4, the right foot 120 includes a mating surface 124 for contacting a foot pad 114 that is on the lower part of the cylinder body 112. Similarly, the left foot 130 can have a mating surface 134 for contacting a foot pad 116 on the cylinder body 112. The foot pads 114 and 116 can be given any configuration that mates with the respective foot 120, 130 to which it is associated. For example, the foot pads can have a generally planar configuration as the feet 120,130 also have a substantially planar configuration.

The mating surface 124 and the foot pad 114 can also have complimentary features such that the right foot 120 and the cylinder body 112 have a tight fit, thereby limiting sliding motion between the right foot 120 and the cylinder body 112. Similarly, the mating surface 134 of the left foot 130 can have complimentary features with foot pad 116.

The mating surfaces 124, 134 and the foot pad 114, 116 can be secured together by the fasteners 118. For example, the fasteners 118 can engage recesses 126, 136 in the foot pads 114, 116. In particular, the fasteners 118 can pass through holes 128, 138 formed in the feet 120, 130 respectively and into engagement with the recesses 126, 136. In the illustrated example, the recesses 126, 136 in the foot pads 114, 116 can have internal threads thereon to allow a threaded fastener 118 to thread into the foot pads 114, 116. Accordingly, the feet 120, 130 can be removably secured to the cylinder 112 with fasteners 118. Securing the feet 120, 130 to the cylinder 112 can ensure contact between the mating surfaces 124, 134 and corresponding surfaces on the foot pad 114, 116, which can further limit motion between the feet 120, 130 and the cylinder body 112.

By limiting the sliding motion between feet 120, 130 and the cylinder body 112, the shear stress on fasteners 118 can be reduced or eliminated as drifter cylinder 110 moves with respect to slide frame 160 since these complimentary features, instead of the fasteners 118, absorb the shearing forces.

Figure 6:
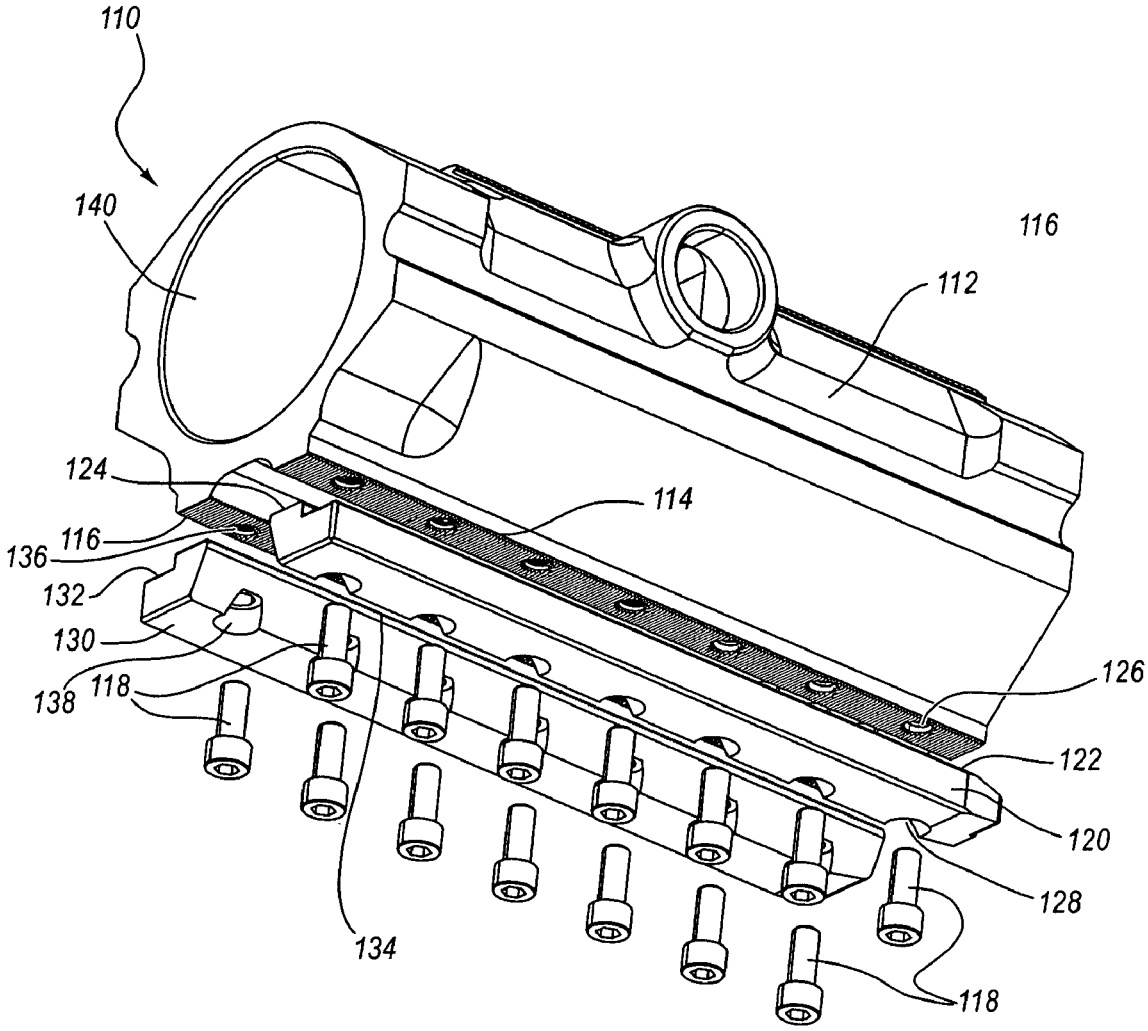
FIG. 6 is a close-up view of a portion of an example embodiment of a drifter cylinder.

Mating surface 124 and foot pad 114 (and/or mating surface 134 and foot pad 116) can have any complimentary features that can limit the shearing forces on fasteners 118 during operation of the drifter rock drill 100. In some embodiments, the complimentary features can be ridges, tooth-shaped features, indentations, or serrated features as illustrated in FIGS. 5 and 6. As well, mating surface 124 (and mating surface 134) can have raised or lowered portions that fit with raised or lowered portions of foot pad 114 (and foot pad 116), in a mortise and tendon configuration. The complimentary features used in one foot/food pad combination can be the same or different than the complementary features used in the other foot/food pad combination. Additionally, the complimentary features used can vary along the length of the foot/foot pad combination.

The fasteners 118 are connected to the cylinder body 112 with sufficient force to make the desired connection. In some examples, each of the fasteners 118 can be attached to the cylinder body 112 using any desired force, for example, between about 50 and 90 Nm of torque. In some embodiments, the fasteners 118 can be tightened in a sequential to provide similar and even contact pressure along the length of the mating surfaces 124, 134 of the feet 120, 130 and the feet pads 114, 116 of the cylinder body 112, respectively. For example, fasteners 118 can be secured in any sequence such that the sequence ensures that no adjacent fasteners 118 are tightened consecutively. One such sequence can include beginning with the fastener positioned at the center of the feet 120 and then tightening a second fastener exteriorly adjacent to the first fastener. Thereafter, a third fastener exteriorly adjacent the first fastener can then be tightened. The remaining fasteners can be tightened by moving to the opposing side of the foot and working outwardly until all of the fasteners 118 are tightened. Similarly, fasteners 118 can be first tightened to a lower torque, such as 50 Nm, in the sequence, and then tightened to a final torque, as desired, in the same sequence. In at least one example, the fasteners 118 can be first tightened to around 50 Nm, then to 70 Nm, and finally to about 80 Nm.

By using the fasteners 118, the foot 120 and/or foot 130 can be removed when desired. Providing replaceable feet can allow the feet 120, 130 to be replaced without having to replace or recondition the entire drifter cylinder 110. For example, feet 120 and 130 can be replaced ten (or even more) times before the entire drifter cylinder 110, or any component of the drifter cylinder 110, must be replaced or reconditioned. This replacement results in substantial savings, both in terms of time and money.

Using the complimentary features on the mating surfaces 124 and 134 can result in longer lasting fasteners 118. With the complimentary features on mating surfaces 124 and 134, less stress is placed on the fasteners 118 from the vibratory drilling motion. Instead, this stress is absorbed primarily by the complimentary features. Consequently, the fasteners 118 are not loosened during operation or broken, which could potentially damage various components of the drifter rock drill 100, including the slide frame 160.

The feet 120 and 130 can be removed and replaced in the following manner. The condition of the feet is monitored, whether manually or by any known instrumentation. When any individual foot (or feet) needs removal (such as when it is damaged or worn and needs to be replaced), the drifter cylinder 110 is removed from the sliding frame 160. The fasteners 118 to that foot (or feet) are then removed in any desired sequence. A new foot (or feet) containing a mating surface matching the foot pad is then selected and attached with fasteners, in any desired sequence. Optionally, other components of the drifter cylinder 110 can then be replaced. The drifter cylinder 110 can then be recoupled to the slide frame 160 and other components of the rock drill 100.

In addition to any previously indicated modification, numerous other variations and alternative arrangements can be devised by those skilled in the art without departing from the spirit and scope of this description, and appended claims are intended to cover such modifications and arrangements. Thus, while the information has been described above with particularity and detail in connection with what is presently deemed to be the most practical and preferred aspects, it will be apparent to those of ordinary skill in the art that numerous modifications, including, but not limited to, form, function, manner of operation and use can be made without departing from the principles and concepts set forth herein. Also, as used herein, examples are meant to be illustrative only and should not be construed to be limiting in any manner.

The present invention can be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A rock drill, comprising:

a cylinder body including a central channel adapted to be connected in line to a percussive drill bit, the cylindrical body including a bottom side having a foot pad extending there along, the foot pad including a plurality of ridges extending therefrom;

a sliding frame; and a support member removably connected to the cylinder body, the support member having a mating surface, the mating surface including a plurality of corresponding ridges adapted to mate with the plurality of ridges of the foot pad, wherein the support member is configured to guide the movement of the cylinder body relative to the sliding frame by contacting the sliding frame.

2. The drill of claim 1, wherein the support member is connected to the cylinder body with a plurality of fasteners.

3. The drill of claim 2, wherein the plurality of fasteners are bolts.

4. The drill of claim 1, wherein the foot pad is generally planar.

5. The drill of claim 1, wherein the plurality of ridges of the foot pad and the plurality of corresponding ridges of the support member are configured to limit shearing motion between the cylinder body and the support member.

6. The drill of claim 5, wherein the plurality of ridges are serrated.

7. The drill of claim 1, wherein the support member is configured to be received at least partially within the sliding frame.

8. The drill of claim 1, wherein the rock drill comprises a pneumatic or hydraulic percussive drifter.

9. The drill of claim 1, further comprising a plurality of support members.

10. A rock drill, comprising:

a cylinder body connected to a drill bit, the cylinder body having a bottom side having a first foot pad and a second foot pad extending there along, the first foot pad having a first plurality of mating features, the second foot pad having a second plurality of mating features;

a sliding frame;

a first support member adapted to be removably connected to the first foot pad of the cylinder body with a first plurality of fasteners, the first support member having a first plurality of corresponding mating features adapted to intermesh with the first plurality of mating features thereby reducing transfer of shear forces to the first plurality of fasteners; and a second support member adapted to be removably connected to the second foot pad of the cylinder body with a second plurality of fasteners, the second support member having a second plurality of corresponding mating features adapted to intermesh with the second plurality of mating features thereby reducing transfer of shear forces to the second plurality of fasteners;

wherein each of the first support member and the second support member is configured to slidingly engage the sliding frame.

11. The drill of claim 10, wherein the plurality of fasteners includes bolts.

12. The drill of claim 10, wherein the first and second plurality of mating features of the body and the first and second plurality of corresponding mating features of the support members are configured to limit shearing motion between the cylinder body and the support members.

13. The drill of claim 12, wherein the first and second plurality of mating features comprise tooth-shaped features.

14. The drill of claim 13, wherein the first plurality of mating features extend along substantially the entire length of the first foot pad.

15. The drill of claim 10, wherein the rock drill comprises a pneumatic or hydraulic percussive drifter.

16. The drill of claim 10, wherein the cylinder body includes a central channel adapted to be connected in line to the drill bit.

* * * * *

UNITED STATES PATENT AND TRADEMARK OFFICE

CERTIFICATE OF CORRECTION

PATENT NO. : 7,997,351 B2
APPLICATION NO. : 12/337510
DATED : August 16, 2011
INVENTOR(S) : William J. Murray It is certified that error appears in the above-identified patent and that said Letters Patent is hereby corrected as shown below:

On the Title Page, Item 57, Page 1, Right Hand Column
Line 6, change "complimentary" to --complementary--
Line 8, change "have" to --having--

Column 1
Line 64, change "have" to --having--

Column 3
Line 50, change "FIG. 4" to --FIG. 5--
Line 60, change "complimentary" to --complementary--
Line 64, change "complimentary" to --complementary--

Column 4
Line 16, change "complimentary" to --complementary--
Line 19, change "complimentary" to --complementary--
Line 22, change "complimentary" to --complementary--
Lines 27-28, change "complimentary" to --complementary--
Line 28, change "foot/food pad" to --foot/foot pad--
Line 31, change "complimentary" to --complementary--
Line 66, change "complimentary" to --complementary--

Column 5
Line 1, change "complimentary" to --complementary--
Line 4, change "complimentary" to --complementary--

Signed and Sealed this
Tenth Day of January, 2012

David J. Kappos

David J. Kappos
*Director of the United States Patent and Trademark Office*